United States Patent [19]

Dubs

[11] 4,144,609

[45] Mar. 20, 1979

[54] BRUSH FOR THE CLEANING OF FIREARM BORES AND GUN BARRELS

[76] Inventor: Werner Dubs, Erlengutstrasse 8, 8703 Erlenbach, Switzerland

[21] Appl. No.: 835,891

[22] Filed: Sep. 23, 1977

[30] Foreign Application Priority Data

Oct. 15, 1976 [DE] Fed. Rep. of Germany ..... 2646576

[51] Int. Cl.[2] ..... A46B 7/10

[52] U.S. Cl. ..... 15/104.2; 15/181

[58] Field of Search ..... 15/104.2, 181, 179, 15/160, 164

[56] References Cited

U.S. PATENT DOCUMENTS

| | | | |
|---|---|---|---|
| 431,526 | 7/1890 | Miller et al. | 15/104.2 |
| 1,189,798 | 7/1916 | Dillon | 15/104.2 |
| 2,124,114 | 7/1938 | L'Hommedieu | 15/181 X |
| 2,601,691 | 7/1952 | Dyer | 15/104.2 |

FOREIGN PATENT DOCUMENTS

| | | | |
|---|---|---|---|
| 1021758 | 12/1957 | Fed. Rep. of Germany | 15/104.2 |

*Primary Examiner*—Edward L. Roberts

*Attorney, Agent, or Firm*—Hill, Gross, Simpson, Van Santen, Steadman, Chiara & Simpson

[57] ABSTRACT

A gun cleaning brush for cleaning firearm bores including a central spindle rod with a plurality of freely rotatable circular brush units on the spindle and end pieces at the spindle with conically shaped transition pieces between the bristles and the end pieces.

6 Claims, 1 Drawing Figure

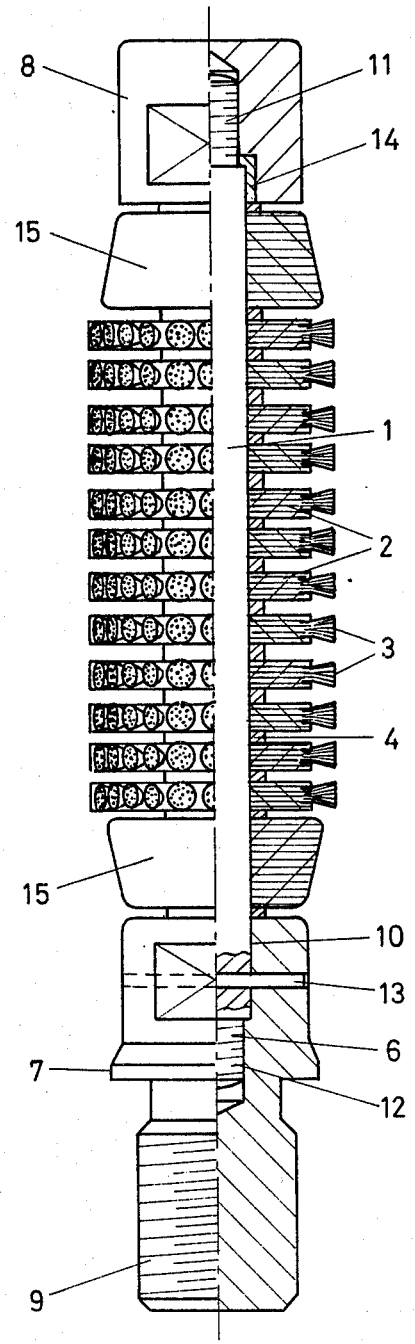
8
11
14
15
1
2
3
4
15
10
13
6
7
12
9

BRUSH FOR THE CLEANING OF FIREARM BORES AND GUN BARRELS

BACKGROUND OF THE INVENTION

The invention relates to a uniquely constructed brush for the cleaning of firearm bores and gun barrels, and more particularly of the type which is moved axially back and forth through a gun barrel for cleaning the rifling and spaces between the rifling and the bore without damage and obtaining improved cleaning results.

With known gun cleaning brushes, difficulties have been encountered in insertion of the brushes into the bores of the gun barrels to be cleaned. In previously available devices, the brush had to be inserted in almost exact axial alignment, or otherwise, the cleaning unit would wedge and lock and cause damage to the brush upon insertion or damage to the gun barrel end. Another disadvantages that has been encountered is that during insertion and during axial movement because of the result of the forces necessary for cleaning, the brush assemblies easily broke at the connection points between the ends and the main supporting spindle, particularly due to stress because of the rotary movements of the brush unit.

SUMMARY OF THE INVENTION

The present invention has an objective of overcoming these disadvantages involved with insertion and operation. In accordance with the principles of the invention, one feature is that a transition cone is positioned on a spindle between an end of the brush assembly and the bristle assembly, and means are provided for improved connection between the end pieces and the spindle which prevent breakage.

It is accordingly an object of the invention to provide an improved gun cleaning brush bristle assembly wherein units are arranged which are freely rotatable relative to each other so that the brush units can follow or rotate with the lands and so that improved cleaning is achieved, and additionally stress is not introduced to the supporting spindle for the bristles.

A further object of the invention is to provide an improved assembly and connection arrangement for the end pieces and main support spindle for the bristles of a gun cleaning brush wherein the unit can be inserted at an angle to the end of the gun barrel without damage to the gun barrel and without damage to the brush and where the unit in essence straightens itself axially without introducing lateral stresses that tend to break the connection between parts.

A still further object is to provide an improved assembly and relationship of parts wherein the gun cleaning brush can be more easily assembled and disassembled and wherein the improved assembly arrangement does not detract, but enhances the strength of the gun cleaning brush and enhances its effective cleaning action.

Other objects, advantages and features, as well as equivalent arrangements thereof which are intended to be covered herein will become more apparent with the disclosure of the preferred embodiment in connection with the teaching of the principles of the invention in the disclosure of the specification, claims, and drawings, in which:

DRAWINGS

The single FIGURE of the drawings is an elevational view with the right one-half portion of the drawing in section of a gun cleaning brush embodying the principles of the invention.

DESCRIPTION

The wire gun cleaning brush is shown having a central spindle 1, or rod, which is circular in cross-section and is made of steel. Mounted on the rod and freely rotatable thereon are a number of bristle disks 2. The bristle disks are suitably made of synthetic material such as fibrous disks impregnated with phenolic resin or an epoxy resin to support the bristles around their outer periphery. The bristles are held at their base in the disks and are arranged in circular bundles projecting radially outwardly evenly circumferentially spaced.

In order to keep the disks 2 at uniform axial spacing on the rods, and to prevent them locking against each other due to interference between the bristles, each of the disks has a flange 4 which is of smaller diameter and projects axially. These flanges provide for reduced friction between adjacent disks so as to encourage free rotation of the bristle disks relative to each other. This is important when the bundles of bristles drop into the grooves between the lands in the firearm bore. For this purpose, the circumferential spacing of the groups of bristles corresponds with the number of spaces between the lands, or in other words, to the grooves in the firearm bore. Thus, as the gun cleaning brush is inserted axially into the gun barrel, the individual bundles of bristles will drop into the grooves between the lands and follow the same as the unit is slid to and fro axially in the firearm bore. Thus, each disk can assume its own position with its own bundles of bristles in the grooves, which leads to a better and more effective cleaning operation. The bundles of bristles consist preferably of steel wires as, for example, with 0.08 or 0.1 mm diameter. The size or strength of the wires and the numbers of bundles of bristles depends upon the gun barrel which is to be cleaned.

At both ends of the spindle, the spindle is threaded as shown at 6 and 11. At the upper end, in the position shown in the drawing, is an end piece 8 which is made of brass. At the lower end is another end piece 7 which is made of brass. Each of the end pieces are internally axially threaded so that they can be screwed securely onto the ends of the spindle. For this purpose, the end pieces have a flattened cheek portion on their faces 180° apart so that a tightening wrench can be applied to each end piece simultaneously to rotate them securely onto the ends of the spindle. 1½

The spindles and end pieces are uniquely constructed with an arrangement which adds to the strength and prevents breakage of the spindle or end piece due to bending forces. For the end piece 7, it has a bored section 10 extending beyond the threaded portion receiving the spindle end 6, which is cylindrically shaped and fits very tightly over the unthreaded portion of the spindle. The diameter of the bored portion 10 is substantially the same or only slightly greater. For a tight fit, the bored section 10 has a length which corresponds to approximately 1-½ times the diameter of the spindle. For securing the end piece 7 onto the spindle, a laterally extending pin 13 extends across an aligned hole extending through the end piece and the spindle. Because the bore of this pin 13 extends through the smooth portion 10, it will not interfere with the threads and will not weaken that portion of the spindle. Because the load on this connective area between the spindle 1 and the end piece 7 is unusually high, this connection construction has been found to provide unusual strength. As above stated, the length of the bored section 10 must be sufficiently long and is preferably in the range of equal to the diameter of the spindle to two times the diameter of the spindle.

The upper end piece 8 is not required to withstand the bending forces which are thrust upon the lower end piece 7. Both end pieces are preferably made of brass. The upper end piece is counterbored and a steel sleeve 14 is inserted to the counterbore having an outer diameter to fit snugly into the counterbore of the end piece 8 in the inner diameter to fit snugly over the end of the spindle. The steel sleeve may have a flange at its upper end so as to seat against the shoulder formed at the ends of the threads 11 on the spindle. The end piece 8 may be formed with a construction so as to accommodate the connection of a draw or pull cord to pull the brush through the gun bore.

Between each of the end pieces 7 and 8 and the bristle disks 2 mounted thereon is positioned a transition cone 15. The transition cones also are preferably constructed so as to be freely rotatable on the spindle 1, although they may be secured nonrotatably thereon. The transition cones are preferably constructed of a synthetic material, such as a polyamide and function to center the brush when it is introduced into the firearm bore. For this reason, the greatest diameter of the conically shaped transition cone 15 is at its axially outward ends, and the larger diameter is adjacent the bristles. The larger diameter, however, is smaller than the outer diameter of the outer ends of the circle of the bundles 3 of bristles. This outer diameter is, however, somewhat larger than the outer diameter of the disks themselves without the bristles. When assembling the unit the lower end piece is first threaded onto the spindle and then secured by the locking pin. Next the lower transition cone, the bristles and the upper transition cone are slipped over the spindle. Finally the upper end piece is threaded onto the spindle. Thus it will be seen that I have provided an improved gun cleaning brush which performs an improved cleaning job and will withstand the forces and stresses of repeated cleaning operations without breakage or damage.

I claim as my invention:

1. A gun cleaning brush for cleaning firearm bores containing rifling, comprising in combination:

a central elongate spindle;

a plurality of spaced circular brush unit means adjacent each other mounted freely rotatable on the spindle, each of said brush unit means independently self-adjusting for alignment with the rifling within the bore;

end pieces at each end of the spindle;

transition cones between each of the end pieces and the plurality of brush unit means;

means securing the end pieces to the spindle preventing breakage of the end pieces from the spindle;

one of the end pieces being internally threaded for receiving one end of the spindle which is externally threaded, a shoulder being formed on the spindle at the external threading, a steel sleeve having a flange being positioned in an enlarged portion of the bore, said one end of the spindle being received through the sleeve such that said shoulder abuts against the flange when said one end piece is tightened;

the other of the end pieces having means for attachment to a polishing rod and also having an axial bore containing an internally threaded portion and a smooth portion, said threaded portion receiving external threads on the other end of the spindle and the smooth portion being in tight fitting relationship with an unthreaded smooth portion of the spindle; and a pin securing said other end of the spindle to the other end piece, said pin passing through the smooth portion of the axial bore and the unthreaded smooth portion of the spindle.

2. A gun cleaning brush for cleaning firearm bores constructed in accordance with claim 1:

wherein said transition cones are constructed of a plastic material so that they will not scratch the interior of the gun bore.

3. A gun cleaning brush for cleaning firearm bores constructed in accordance with claim 1:

wherein said brush unit means include bristles projecting radially from fibrous bristle disks and are substantially evenly circumferentially spaced, and each of the bristle disks has a spacing flange of lesser diameter than the disk for providing a spacing between adjacent disks.

4. A gun cleaning brush for cleaning firearm bores constructed in accordance with claim 1:

wherein each of the transition cones is tapered from an area of larger diameter adjacent the brush unit means to an area of smaller diameter adjacent the end pieces.

5. A gun cleaning brush according to claim 1 wherein a length of the smooth portion of the axial bore is in a range from one to two times a diameter of the spindle.

6. A gun cleaning brush for cleaning firearm bores comprising in combination:

a central elongate spindle rod being threaded at each end and being smooth and unthreaded throughout its length to the threaded ends;

a top end piece threaded onto one end of the spindle;

a bottom end piece threaded onto the other end of the spindle and being theaded at its outer end for the connection of a polishing rod;

said bottom end piece having an axial bore containing an internally threaded portion and a smooth portion, said threaded portion receiving external threads on the other end of the spindle and the smooth portion being in tight fitting relationship with an unthreaded smooth portion of the spindle inwardly adjacent the external threads of the spindle, a length of said axial bore smooth portion being between 1 and 2 times a diameter of the spindle;

a securing pin being provided at the smooth portion of the axial bore;

upper and lower transition cones in the form of a plastic material having smaller diameter adjacent the end pieces and being formed of a plastic material;

and a plurality of circular independently rotatable brush units in stacked relationship along the spindle between the transition cones, each of the brush units having a circular bristle disk with the bristles mounted therein and projecting radially outwardly therefrom at a uniformly spaced circumferential location, each of the disks having an axially extending spacing flange at its base of a smaller diameter than the disk for spacing each of the disks from each other.

* * * * *